United States Patent [19]

Reick

[11] 4,333,840

[45] Jun. 8, 1982

[54] HYBRID PTFE LUBRICANT FOR WEAPONS

[75] Inventor: Franklin G. Reick, Westwood, N.J.

[73] Assignee: Michael Ebert, Mamaroneck, N.Y.; a part interest

[21] Appl. No.: 233,894

[22] Filed: Feb. 12, 1981

Related U.S. Application Data

[63] Continuation-in-part of Ser. No. 218,008, Dec. 18, 1980, which is a continuation-in-part of Ser. No. 158,329, Jun. 10, 1980, Pat. No. 4,284,518.

[51] Int. Cl.[3] ..... C10M 5/10; C10M 5/18

[52] U.S. Cl. ..... 252/16; 252/46.4; 252/54.6; 252/58

[58] Field of Search ..... 252/16, 54.6, 58, 46.4

[56] References Cited

U.S. PATENT DOCUMENTS 3,933,656 1/1976 Reick ..... 252/58

4,127,491 11/1978 Reick ..... 252/16

4,263,152 4/1981 King et al. ..... 252/46.4

4,284,518 8/1981 Reick ..... 252/16

*Primary Examiner*—Winston A. Douglas

*Assistant Examiner*—J. V. Howard

*Attorney, Agent, or Firm*—Michael Ebert

[57] ABSTRACT

A lubricant especially adapted to meet the requirements of firearms, the lubricant being constituted by a dispersion of microfine PTFE particles in an oil carrier diluted with a major amount of synthetic lubricant having a low viscosity and a high viscosity index, whereby the resultant hybrid lubricant not only reduces wear and friction, but also affords a protective coating for the treated metal surfaces which resists the adhesion thereto of grime, powder, lead and all other contaminants that otherwise make it necessary to frequently clean the weapon to maintain it in proper working order.

7 Claims, No Drawings

HYBRID PTFE LUBRICANT FOR WEAPONS

RELATED APPLICATION

This application is a continuation-in-part of my copending application Ser. No. 218,008, filed Dec. 18, 1980, entitled HYBRID PTFE LUBRICANT INCLUDING MOLYBDENUM COMPOUND, which in turn is a continuation-in-part of my copending application Ser. No. 158,329 filed June 10, 1980, now U.S. Pat. No. 4,284,518 which relates back through still earlier patent applications to Ser. No. 809,805, now U.S. Pat. No. 4,127,491, all of whose disclosures are incorporated herein by reference.

BACKGROUND OF INVENTION

This invention relates generally to lubricants, and more particularly to a hybrid lubricant especially adapted to meet the requirements of firearms.

The term "firearm" encompasses any weapon from a pocket pistol to a heavy siege gun consisting essentially of a barrel and explosive means to discharge a bullet or projectile through the barrel, the sudden expansion of gases from the explosive driving the projectile out of the barrel. The function of the gun barrel is to enable the projectile to reach a suitable high velocity in a very short time, the energy released by ignition of the propellent charge serving to give to the projectile the direction which in combination with its velocity will carry it to the intended target.

To obtain a high initial velocity, a long barrel is necessary; but regardless of the caliber or bore of the gun, the muzzle velocity—that is, the velocity of the projectile on emerging from the muzzle of the gun—tends toward a maximum value that cannot be further increased even by using a larger propellent charge. However, a better lubricated bore will afford a measurable increase in muzzle velocity.

Modern weapons include relatively complex mechanisms which to function smoothly and reliably require effective lubrication. Thus in an automatic rifle provided with trigger, magazine loading and breech mechanisms, these mechanisms as well as the barrel must be carefully cleaned and lubricated in order to maintain the weapon in good working order.

Since these mechanisms, even when the components are fabricated of stainless steel, are subject to chemical attack, particularly at elevated operating temperatures, it is essential that the lubricant not only function to reduce friction and wear, but that it also act to inhibit rusting and erosion of the parts.

Existing lubricants for weapons, though effective in reducing friction, have certain disadvantages. Thus while many lubricants work well under moderate temperature conditions, they tend to coagulate at very low ambient temperatures and thereby jam the mechanism. Other lubricants are adversely affected by the elevated temperatures sometimes encountered in rapidly-fired automatic weapons, such temperatures approaching 500° F. Also, the typical gun lubricant usually leaves a sticky oil residue which picks up dust particles; and unless the gun is frequently and thoroughly cleaned, the resultant accumulation may have detrimental effects.

Moreover, lubricants of the type heretofore available do not prevent a lead residue and powder from adhering to the bore surface and building up to a point where it becomes necessary to thoroughly clean the bore after a relatively small number of shots.

SUMMARY OF INVENTION

In view of the foregoing, the main object of this invention is to provide a lubricant for firearms which obviates the drawbacks of existing lubricants and which not only reduces wear and friction, but also makes it possible to maintain the weapon in good working order without frequent cleaning and to attain a smoother and faster operation.

More particularly, an object of this invention is to provide a hybrid lubricant in which microfine PTFE particles are uniformly and stably dispersed in a relatively high viscosity oil carrier diluted with a major amount of a synthetic oil lubricant of low viscosity, the particles impregnating the microscopic voids in the metal surfaces of the weapon to form a protective coating thereon of exceptional lubricity.

Among the significant features of a lubricant in accordance with the invention is that it is non-coagulating and unaffected by excessive cold or heat, the lubricant being operational from minus 60 degrees to plus 500 degrees Fahrenheit. Superior operation is obtained in semi-automatic and automatic weapons and other gun movements, and cleaning time is reduced. Also, the protective layer formed by the lubricant on the inner surface of the barrel base strongly resists adhesion thereto of grime, lead and powder deposits, thereby drastically reducing the cleaning requirements of the weapon, both with respect to the time it takes to clean the weapon and the frequency of cleaning.

DESCRIPTION OF INVENTION

A lubricant in accordance with the invention is constituted by an oil additive of the type disclosed in my above-identified related applications and patents in the form of a hybrid lubricant having PTFE microfine particles dispersed therein and a making use of a conventional hydrocarbon lubricating oil carrier having viscosity characteristics suitable for engine crankcase use, this additive being diluted in a synthetic lubricant having low viscosity and other characteristics appropriate to weapon applications.

The preferred ratio of the additive to the synthetic lubricant is about one part additive to four parts synthetic lubricant. We shall therefore first describe an acceptable formulation for the additive and how it is prepared, and then disclose synthetic lubricants suitable as a diluent for the additive.

The Additive

The additive is a hybrid lubricant that includes a solid lubricant in the form of microfine particles of polytetrafluoroethylene (PTFE), preferably of sub-micronic size. Suitable as the starting material for a hybrid lubricant in accordance with the invention are the duPont "Teflon" aqueous dispersions TFE-42 and T-30 whose particle sizes are in the 0.5 to 0.05 micron range. Also acceptable is the "Fluon" ADO 38 TFE colloidal dispersion manufactured by ICI (Imperial Chemical Industries, Ltd.). The steps for making the additive are as follows:

Step No. 1

The aqueous dispersion of colloidal PTFE particles must first be rendered stable to avoid agglomeration of the particles. For this purpose, use is made of a fluorochemical surfactant which acts to neutralize or stabilize the surface charges in the particles to make them more uniform and thereby prevent "electret" or other effects causing agglomeration.

Best results are obtained when the PTFE dispersion to be treated is received from the pressure reactor immediately following polymerization. PTFE particles are extremely hydrophobic and air tends to wet the particles better than water. It is for this reason that the solutions are usually shipped with a mineral oil layer to keep gases away and retard agglomeration. And while to make the hybrid lubricant, one may use commercially-available PTFE dispersions that have been shipped and stored as long as the dispersions are reasonably free of agglomerates, it is preferable to start with ex-reactor dispersions to sidestep the danger of agglomeration.

Fluorochemical surface active agents, or surfactants, are available which are anionic, ationic or nonionic. Among these fluorosurfactants are Zonyl (duPont) and Monoflor (ICI). Zonyl is a modified polyethylene glycol type that is nonionic. For engine lubrication applications, good results have been obtained with an anionic (−) fluorosurfactant commercially available from ICI. Monoflor 32, produced by ICI, is of particular interest, this being an anionic fluorochemical whose composition is 30% w/w active solids in diethylene glycol mono butyl ether.

Step No. 2

The stabilized aqueous PTFE dispersion produced in Step No. 1 is then intermingled with a fluid lubricant carrier of the type presently used in crankcases for auto engine lubrication. By intermingling the stabilized aqueous PTFE dispersion with the carrier, an emulsion is formed. For this purpose, use may be made of Quaker State 10W-40 SAE lubricating oil, Shell X-100, or Uniflo oil.

Step No. 3

In the emulsion formed in step no. 2, the aqueous dispersion is distributed throughout the oil carrier in the form of relatively large globules. It is desirable that this emulsion be homogenized by subjecting it to turbulent treatment to cause the globules to break up and reduce in size to create a fine uniform dispersion of colloidal PTFE in the fluid lubricant carrier.

To promote such homogenization, use is preferably made of a polymeric dispersant such as ACRYLOID 956 manufactured by Rohm and Haas. This dispersant, which is generally used as a viscosity index improver or sludge dispersant, is a polyalkylmethacrylate copolymer in a solvent-refined neutral carrier oil. Also useful for this purpose are GANEX V516 polymeric dispersants manufactured and sold by GAF. To obtain a very fine particle dispersion in the emulsion, this step is preferably carried out in two successive stages. In the first stage, a portion of the dispersant is sheared into the high viscosity Acryloid 956, after which the remainder is added.

Step No. 4

As a result of carrying out steps 1 to 3, we now have a homogenized emulsion in which stabilized PTFE particles are uniformly dispersed in a fluid lubricant carrier. In step 4, added to this emulsion is an adsorbent surfactant which will render the metal surfaces to be lubricated conducive to impregnation by the colloidal PTFE particles. A preferred surfactant for this purpose is Surfy-nol 104 manufactured by Airco Chemicals and Plastics. This is a white, waxy, solid tertiary, acetylenic glycol which has an affinity for metal and functions as a wetting agent. It improves adhesion on metal due to its excellent wetting power.

Step No. 5

In this step, which is optional, there is added to the hybrid PTFE lubricant produced by steps 1 to 4 a small but effective amount of an oil-soluble molybdenum compound of the type presently available commercially as an additive to automobile lubricating oils for heavy loads and extreme pressure (EP) applications.

One example of this compound is "MOLYVAN L," the trademarked product of the R. T. Vanderbilt Company, Inc., of Norwalk, Conn. This organic molybdenum compound is composed of molybdenum as $MoO_3$ (10.6%), sulfur (14.0%) and phosphorus (4.5%).

Another example is Elco L-28901 (molybdenum dialkyl eithiophosphate), produced by the Elco Corporation of Cleveland, Ohio. This oil-soluble additive contains a high concentration of molybdenum in relation to phosphorus and sulfur. In the Elco compound, the molybdenum-to-phosphorus ratio is typically 5 to 1. As pointed out in the Preliminary Bulletin published by Elco, this compound is soluble in all types of lubricating oils and acts not only as an extreme pressure, anti-wear agent, but also as an antioxidant. In many instances, its activity is enhanced by the incorporation of Elco 217, a sulfurized hydrocarbon.

Other examples of oil soluble compounds based on molybdenum, such as sulphurized oxymolybdenum organophosphorodithiolate and molybdenum dithiolate, are disclosed in the article by Braithwaite and Greene, "A Critical Analysis of The Performance of Molybdenum Compounds in Motor Vehicles, " appearing in *Wear*, Vol. 46., No. 2, pp 405–432, February 1978.

An oil-soluble organic molybdenum compound of the type commercially available does not significantly enhance the lubricating characteristics of standard lubricating oils under ordinary pressure conditions, such as those encountered in broad contact areas, and is not prescribed in the literature for such applications.

We have discovered, however, that when the soluble moly compound is combined with a hybrid lubricant containing PTFE particles dispersed by a fluorochemical surfactant, a synergistic effect is obtained, resulting in a marked reduction of friction throughout the entire pressure range when a small but effective amount thereof is included in the hybrid lubricant, such as about 1%.

In operation, when lubricating rubbing metal surfaces, an extremely fine film of the molybdenum compound is developed on the metal surfaces. Because of the high temperature and high pressure conditions which prevail at the interface of the rubbing surfaces, this film reacts with the fluorochemicals which are carried into the interface to form a fluoride (molybdenum hexafluoride). It is known that when heated in the presence of fluorine, chlorine or promine, molybdenum combines directly to form the corresponding halogen derivative. In the case of a fluorine, molybdenum hexafluoride is the reaction product, this being a white, crystalline substance.

This substance has an affinity for the PTFE particles which care caused in the course of operation under the prevailing conditions of temperature and pressure to bond tightly to the fluoride skin formed on the metal surface (particularly steel) to create an extremely thin PTFE layer thereon having an extremely low coefficient of friction. This layer survives even under extreme pressure; and though it may be eroded with time, it is recreated in the course of operation by the presence of the moly compound and the PTFE particles.

Thus, even in the case of steel and other metals which resist surface impregnation by PTFE particles, the inclusion of the moly compound makes possible the formation thereon of a PTFE anti-friction layer.

While the relative amount of molybdenum compound in the hybrid lubricant is not critical, we have found in our tests that when the percentage of the compound is less than about 1%, such as ½ and ¼ percent, in plotting temperature against time, the resulting characteristic curve proceeds to approach the curve obtained with the hybrid lubricant in the absence of the moly compound, wherein the temperature rises with time; and that when the percentage of the compound exceeds 1%, again the characteristic curve proceeds to approach that of the untreated hybrid lubricant—the larger the percentage of moly above 1%, the greater the rise in temperature with time.

When, however, the percentage of moly is about one percent in the hybrid lubricants tested, the curve of temperature vs. time flattens out after reaching a relatively low temperature level.

Hence in practice, the percentage of the molybdenum compound must be small and should be such as to attain for a given hybrid lubricant containing PTFE particles dispersed therein, an optimum relationship between time and temperature. We believe that if the amount of the moly compound is excessive relative to the hybrid PTFE lubricant, the resultant film formed on the metal surface is unduly thick and has a lesser tendency to react to produce the fluoride skin; whereas if the amount is insufficient, a film adequate for creating the fluoride skin is not produced.

The Synthetic Lubricant

One preferred synthetic lubricant for diluting the additive produced by the steps recited above is a polyalphaolefin marketed by Gulf Oil Company under the trademark "Synfluid." This synthetic lubricant has a high viscosity index (125–140) so that its resistance to viscosity changes with temperature is much more favorable than conventional mineral oils. As compared to mineral oils of the same viscosities, it has low volatility relative to viscosity, so that evaporation losses are low. Synfluid has high temperature stability and low temperature fluidity, providing an exceptionally low pour point and low viscosities at extremely cold temperatures, whereby coagulation is avoided when a weapon uses a lubricant in accordance with the invention in cold climates or high altitude environments. And because of the hydrolytic stability of Synfluid, this insures stability in the presence of water, thereby reducing rust.

Also usable to dilute the additive is a diabasic acid ester, such as "Kemester" 5654 produced by Humko Shieffield of Memphis, Tenn., a division of Kraft, Inc. This diabasic acid ester, produced by the reaction of long-chain alcohols and a diabasic acid that is mostly adipic acid, is characterized by excellent low temperature properties in terms of viscosity and pour point, good thermal and oxidative stability, lower volatility than mineral oils, a high viscosity index, a broad operating temperature range capability, and low-depositforming tendencies. In practice, any synthetic fluid lubricant having properties similar to those set forth above may be used to dilute the additive.

It is also desirable to include with the synthetic oil diluting the additive, rust and corrosion inhibitors. Suitable for this purpose is one percent of "Cobratek" TT-100 produced by Sherwin Williams Chemicals, this being constituted by benzotriazole and tolytriazole, which is particularly effective in inhibiting corrosion of copper and copper alloys, as well as steel. To this may be added as a salt inhibitor constituted by 2% of neutral barium sulfonate. These inhibitors are soluble in the synthetic oil.

Thus by diluting the additive whose carrier oil has a viscosity that is unacceptable in weapon applications with a synthetic lubricant of low viscosity and other properties set forth above, in approximately the ratio of one part additive to four parts of diluent, the resultant hybrid lubricant has advantageous characteristics unique to the weapon field. The same lubricant may be used effectively for applications having similar requirements, such as for lubricating skis where the lubricant must function well at low temperatures.

While there has been shown and described a preferred embodiment of a hybrid PTFE lubricant for weapons in accordance with the invention, it will be appreciated that many changes and modifications may be made therein without, however, departing from the essential spirit thereof.

I claim:

1. A hybrid lubricant especially adapted for use in firearms and similar applications that require a low viscosity lubricant, said hybrid lubricant comprising:

A. a minor amount of an additive constituted by a dispersion of polytetrafluoroethylene solid particles, a neutralizing agent stabilizing the dispersion to prevent agglomeration of the particles, and a fluid oil lubricant carrier of relatively high viscosity intermingled with the stabilized dispersion; and B. a major amount of a synthetic fluid lubricant having a low viscosity diluting the additive.

2. A hybrid lubricant as set forth in claim 1, wherein said neutralizing agent is a fluorochemical surfactant.

3. A hybrid lubricant as set forth in claim 1, wherein said dispersion is of colloidal particles in the sub-micron range.

4. A hybrid lubricant as set forth in claim 1, wherein the ratio of additive to synthetic fluid lubricant is about 1 to 4.

5. A hybrid lubricant as set forth in claim 1, wherein said synthetic fluid lubricant is constituted by a polyalphaolefin having a high viscosity index.

6. A hybrid lubricant as set forth in claim 1, wherein said synthetic fluid lubricant is constituted by a diabasic acid ester.

7. A hybrid lubricant as set forth in claim 5, wherein said synthetic fluid further includes a small percentage of a rust inhibitor.

* * * * *